United States Patent [19]

Hirota et al.

[11] Patent Number: 4,650,088

[45] Date of Patent: Mar. 17, 1987

[54] HERMETIC SEALED CONTAINER WITH PULL TAB

[75] Inventors: Kazumi Hirota; Tamio Fujiwara, both of Tokyo, Japan

[73] Assignee: Toyo Seikan Kaisha, Limited, Tokyo, Japan

[21] Appl. No.: 807,712

[22] Filed: Dec. 11, 1985

[30] Foreign Application Priority Data

Dec. 14, 1984 [JP] Japan ..... 59-264317

[51] Int. Cl.[4] ..... B65D 17/34

[52] U.S. Cl. ..... 220/270; 220/260; 220/359

[58] Field of Search ..... 220/260, 270, 359

[56] References Cited

U.S. PATENT DOCUMENTS 4,557,398 12/1985 Hambleton et al. ..... 220/260

4,577,777 3/1986 Brochman ..... 220/270

*Primary Examiner*—George T. Hall

*Attorney, Agent, or Firm*—Armstrong, Nikaido, Marmelstein & Kubovcik

[57] ABSTRACT

There is disclosed a hermetic sealed container filled with a positive pressure generating contents. The container is sealed with a lid comprising a spherical-shaped outwardly protruded panel portion formed with an opening, and a seal tab bonded to the outer surface thereof to cover the opening.

5 Claims, 4 Drawing Figures

HERMETIC SEALED CONTAINER WITH PULL TAB

BACKGROUND OF THE INVENTION

The present invention relates to a hermetic sealed container, more particularly to a container which is filled with a positive pressure generating contents and hermetically sealed with an easy-opening lid.

Conventionally, the easy-opening lid used for a hermetic sealed container filled with a contents, such as beer or carbonated soft drinks, that generates internal pressure higher than the normal atmospheric pressure in the sealed container is usually of the type that is provided with a rigid, substantially flat, metal panel portion formed with a score line for defining an opening, and a pull tab secured to the panel portion for tearing the score line to open the container.

On the other hand, another easy-opening lid of the type that is provided with a substantially flat panel portion formed with an opening, and a peelable seal tab bonded to the outer surface thereof to cover the opening is also conventionally used for the hermetic sealed container filled with a negative pressure generating contents, such as juices and soups.

The latter easy-opening lid of the seal tab type is more advantageous than the former of the score type in more simple manufacturing procedures and lower manufacturing cost. However, in the case of the hermetic sealed container filled with a positive pressure generating contents, there arise problems that, when the seal tab is bonded with a lower adhesive strength so as to facilitate peeling the seal tab in opening the container, the tab tends to be subjected to spontaneous peeling due to the internal pressure during storage, and when the seal tab is bonded with a higher adhesive strength so as to prevent the tab from peeling spontaneously, the seal tab is hard to peel in opening the container.

In addition, a lid formed of a flexible laminate comprising a metal foil, such as aluminum foil, and a thermoplastic film has been recently employed, since the lid has advantages that it can be bonded by heat sealing to a container body formed of a thermoplastic material or a laminate including the latter, and has gas barrier capability. When a negative pressure generating contents is filled, the lid of the last-mentioned type may be used as a score type, easy-opening lid formed with a score line which reaches the metal foil, or as a seal tab type, easy-opening lid.

When a positive pressure generating contents is filled, however, the lid is difficult for practical application in case of the score type, because the score line is apt to be ruptured by the relatively high positive internal pressure, and in case of the seal tab type, the above-described problems may be encountered.

SUMMARY OF THE INVENTION

It is an object of the present invention to provide a hermetic sealed container which is sealed with an easy-opening lid provided with a seal tab and is filled with a positive internal pressure generating contents, wherein the seal tab may be peeled easily by a hand, and be less susceptible to spontaneous peeling with the positive internal pressure.

According to the present invention there is provided a hermetic sealed container filled with a positive pressure generating contents which is sealed with a lid comprising a spherical-shaped outwardly protruded panel portion formed with an opening, and a seal tab bonded to the outer surface thereof to cover the opening.

Other objects and advantages of the invention will be apparent from the following description and the accompanying drawings.

DETAILED DESCRIPTION OF THE PREFERRED EMBODIMENT

Figure 1:
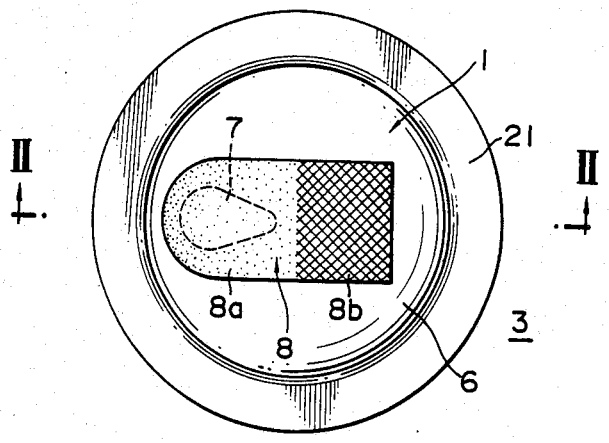
FIG. 1 is a plan view of a preferred embodiment according to the present invention.
Figure 2:
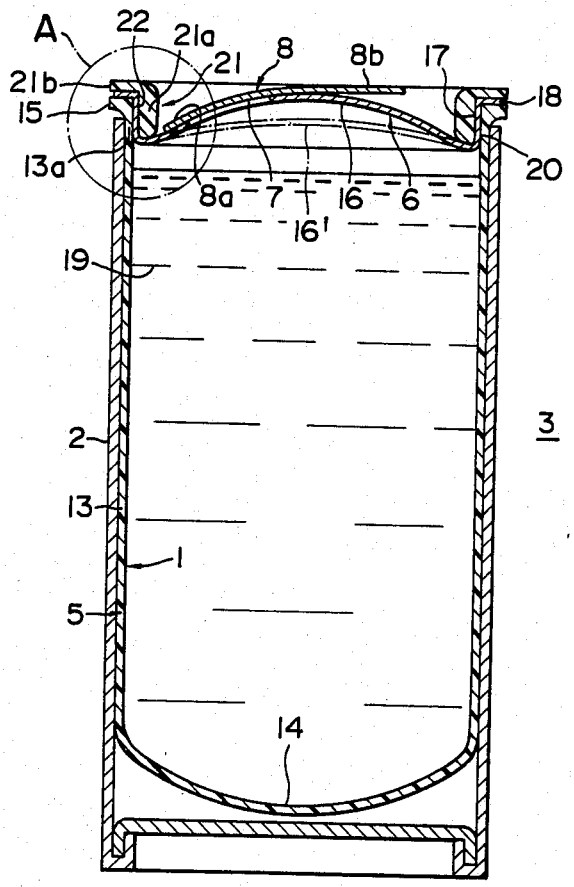
FIG. 2 is a longitudinal section taken on line II—II in FIG. 1.
Figure 3:
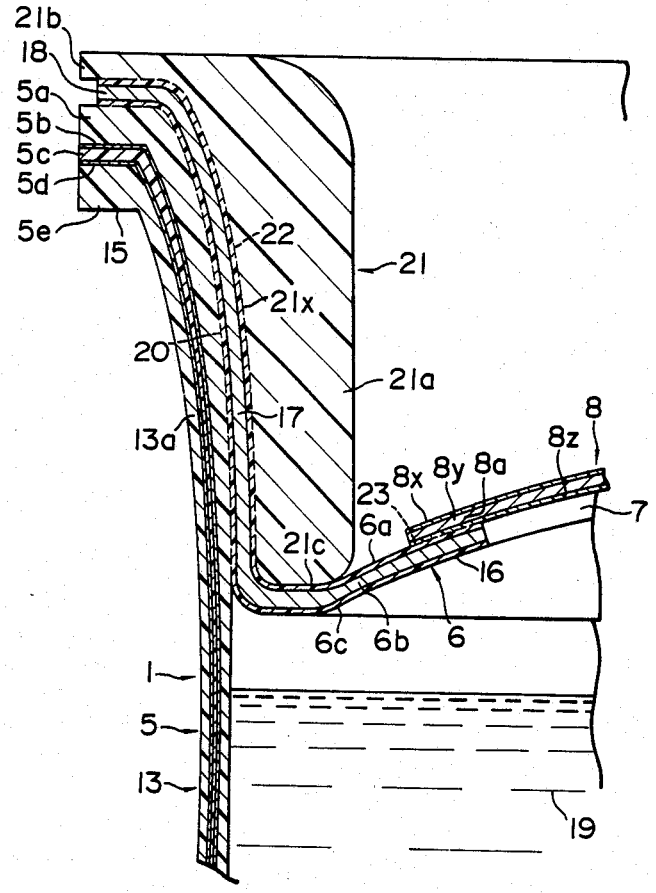
FIG. 3 is an enlarged fragmentary view showing the portion A in FIG. 2.

Referring to FIGS. 1 and 2, a hermetic sealed container 1 is provided with a relatively long cuplike body 5 and a lid 6. The container body 5 has a cylindrical sidewall portion 13, an outward domed bottom 14 and a flange 15 extending radially outwardly from the top end of the open end portion 13*a* of the sidewall portion 13. As shown in FIG. 3, the open end portion 13*a* extends upward from the cylindrical sidewall portion 13 with a small outwardly curved slope.

As illustrated also in FIG. 3, the body 5 consists of a plastic laminate of five layers comprising an inner layer 5*a* of a heat sealable plastic such as polypropylene, a first adhesive layer 5*b* of carboxylic-acid (for example, maleic anhydride)-modified polypropylene, a gas (such as oxygen or carbon dioxide) barrier central layer 5*c* of ethylene-vinyl alcohol copolymer, a second adhesive layer 5*d* of carboxylic-acid-modified polypropylene and an outer layer 5*e* of polypropylene. The body 5 may be formed by introducing a laminate blank with the above-mentioned layer structure into a die cavity at the molecularly orientable temperature while being compressed between upper and lower plungers, according to the method disclosed, for example, in the U.S. Patent No. 4,420,454.

The lid 6 has a panel portion 16, a collar 17 connected thereto and adapted to fit the open end portion 13*a* and a flange 18 extending radially outwardly from the upper end of the collar 17. The panel portion 16 is spherical-shaped, that is, shaped to form part of a sphere, and outwardly protruded. The panel portion 16 is formed with an opening 7 used for discharging the contents. A seal tab 8 covering the opening 7 is bonded by heat sealing to the outer surface of the panel portion 16 at an adhesion area 8*a* thereof. Reference character 8*b* designates a lug portion for peeling the seal tab 8 off the container 1 when opened.

As shown in FIG. 3, the lid proper is formed from a laminate consisting of an outer layer 6*a* of a heat sealable plastic (polypropylene in this embodiment), a metal foil layer 6*b* (for example, of an approximately 80–220 μm thick aluminum foil) and an inner layer 6*c* of polypropylene, which is heat sealable to the inner layer 5*a* of the container body 5, these layers being bonded to one another with adhesive layers not shown, for example, of carboxylic acid modified polypropylene. The laminate is relatively thin, flexible and so tough that it is not broken with a positive internal pressure generated by a contents 19.

The seal tab 8 is formed from a laminate consisting of an outer layer 8*x* of reinforcing plastic film, for example, a biaxially oriented polyethylene terephthalate film, a metal foil layer 8*y*, for example, of an approximately 50 μm thick aluminum foil and an inner layer 8*z* of a heat sealable plastic, for example, preferably a blend of polypropylene (PP) and polyethylene (PE) (PP:PE=9:1 to 6:4 in weight), which is heat sealable to the outer layer 6*a* of the lid 6, these layers being bonded to one another with adhesive layers not shown, for example, of urethane resin adhesive or carboxylic-acid-modified polypropylene adhesive. It is desirable that the laminate is flexible and so tough that it is not ruptured with the positive internal pressure.

The lid 6 may be formed in the following manner. After a laminate blank for forming the lid proper has been formed with the opening 7, the seal tab is heat sealed to cover the opening 7 and form the heat sealed portion 23 in the adhesion area 8*a* of the seal tab 8, thereby forming a lid blank.

Then, the lid 6 is made up by shallow drawing from the lid blank. Even though the panel portion 16 of the lid 6 as shallow drawn and not yet jointed to the body 5 is substantially flat, the panel portion 16 of the flexible laminate is bulged spherically with the positive internal pressure generated by the contents 19 such as beer after hermetic sealing. Therefore, the panel portion 16 prior to sealing may be substantially flat.

It is preferable, however, that a panel portion 16' which is protruded spherically to some extent as shown in FIG. 2 is formed in advance by shallow drawing, and after hermetic sealing the panel portion 16' is farther bulged by the positive internal pressure to form the panel 16 which is bulged considerably as shown also in FIG. 2.

The one reason is that the protruding height of the panel portion 16 in case of the latter is larger than that in case of the former wherein the panel portion prior to sealing is substantially flat, thus leading to a smaller radius of curvature of the panel portion, and therefore the seal tab 8 is less susceptible to spontaneous peeling by the positive internal pressure when the other conditions are the same in both cases, for the reason described hereafter. The other reason is that, in the latter case, radially extending wrinkles caused by the bulging on the periphery of the panel portion 16 are less, resulting in improvement in appearance.

The inner layer 5*a* of the open end portion 13*a* and the flange 15 of the container body 5 are bonded to the collar 17 and the inner layer 6*c* of the collar 17 and the flange 18 of the lid 6, respectively, by heat sealing, thus forming a heat sealed portion 20.

Figure 4:
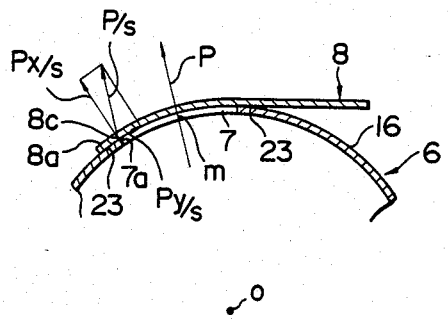
FIG. 4 is a partly sectional fragmentary schematic illustration for explanatorily showing forces acting on the seal tab on a lid of the hermetic sealed container shown in FIG. 2.

The panel portion 16 of the lid 6 and accordingly the adhesion area 8*a* of the seal tab 8 are both spherical-shaped. As illustrated in FIG. 4, a resultant force P due to the positive internal pressure outwardly acts on the seal tab 8 through the portion thereof on the opening 7 of the lid 6. The resultant force P passes through the centers o and m of the curvature of the panel portion 16 which is spherical-shaped and outwardly protruded, and the opening 7, respectively. A radial component force Px/s of P/s wherein s is a circumferential length of the opening 7 acts as a peeling force of the seal tab 8 on a portion 8*c* thereof above the edge surface 7*a* of the opening 7. If the component force Px/s exceeds the peeling strength at the adhesion area 8*a*, the heat sealed portion 23 will begin peeling from the portion 8*c*.

A shearing force Py/s which is a circumferential component force of P/s, also acts on the portion 8*c*. However, since the resistance of the heat sealed portion 23 to a shearing force is far larger than that to a peeling force, it is unnecessary to consider the influence of the shearing force on the separation of the heat sealed portion 23. When the panel portion 16 of the lid 6 is flat, P/s is equal to Px/s. However, the larger the protruded height of the panel portion 16 is, that is, the smaller the radius of curvature thereof is, the smaller the value of Px/P is, and thus the heat sealed portion 23 becomes less susceptible to peeling with the positive internal pressure. To the effect it is preferable that the protruded height of the panel portion 16 is at least 5 mm in case of the container body 5 whose inside diameter is about 50 to 80 mm.

Pulling up the lug portion 8*b* of the seal tab 8 for opening the container 1 will enable the tab to be easily peeled due to cohesive failure caused in the blended resin of the inner layer 8*z* at the adhesion area 8*a* in the present embodiment.

Reference numerals 21 designate a reinforcing ring including a collar 21*a* and a flange 21*b*. The outer surface 21*x* of the ring 21 has a configuration adapted to fit the collar 17, the periphery of the panel portion 16 and the flange 18 of the lid 6. The collar 21*a* has a relatively large wall thickness to be fairly stiff and hardly bent. The collar 21*a* and the flange 21*b* are heat sealed to the outer layer 6*a* of the collar 17 and the flange 18, respectively, both of the lid 6, forming a heat sealed portion 22, so that the reinforcing ring 21 may not be displaced relative to the lid 6 and the container body 5, that is, not be moved upwardly.

Thus, a radial, inward displacement of the collar 17 of the lid 6 is suppressed by the reinforcing ring 21. Accordingly, there is none of danger that a peeled portion with a V-shaped section in the heat sealed portion 20 develops with the positive internal pressure generated by the contents 19 from inside to form a through-hole between the outside and inside of the container 1, resulting in the leakage of the contents. Heat seal between the flange 15 and the flange 18 is not necessarily required from the point of hermetic sealing. However, this heat seal is desirable for obtaining more reliable immobility of the reinforcing ring 21.

Reference numeral 2 designates an outer casing formed from a laminate inclusive of paper board. The outer casing 2 has an inner diameter substantially equal to the outer diameter of the sidewall portion 13 of the container body 5 so as to allow the insertion of the sidewall portion 13 just after hermetic sealing and before bulging of the cylindrical portion 13 due to the positive internal pressure. The outer casing 2 secures standing stability of the container 1 with the outwardly protruded bottom 14 and restrains radial bulging of the sidewall portion 13 with a relatively small wall thickness, for example, of 0.2 to 0.5 mm. The hermetic sealed container 1 and the outer casing 2 form a composite container 3.

It is to be understood that the present invention is not limited to the embodiment described above except as defined by the appended claims. For example, the lid may be formed from a rigid metal sheet, e.g., tinplate or tinfree steel of about 0.2 to 0.4 mm thick to have a spherical-shaped panel portion in advance. This type of lid may be jointed with the container body of metal sheet by double-seaming.

Further, the circumferential inner surface of the opening 7 may be coated by a heat sealable plastic film by heat bonding to cover the edge surface 7*a*, thereby to prevent the edge surface 7*a* where metal is exposed from corroding due to the contents 19.

A practical example will be described below.

PRACTICAL EXAMPLE

A container body 5 of 70 mm inner diameter and 150 mm long of the type shown in FIG. 2 which had a sidewall portion 13 comprising a 270 μm thick outermost polypropylene layer, a 20 μm thick ethylene-vinyl alcohol copolymer layer, a 20 μm thick maleic-anhydride-modified polypropylene layer and a 270 μm thick innermost polypropylene layer was fabricated and through-hole of 8 mm diameter was formed in the bottom 14 of the body 5. The through-hole of the container body 5 was connected with a hydraulic tester through a pipe.

Each of lid members fabricated as below was bonded by heat sealing to the flange 15 and to the open end portion 13*a* of the container body 5, and a reinforcing ring 21 of polypropylene having a bottom end 21*c* of 0.5 mm thick was bonded to the lid 6 by heat fusion, as illustrated in FIG. 3, to form a hermetic sealed container 1.

Two kinds of blanks of lid proper having an opening 7 of the shape as shown in FIG. 1 were formed from a laminate consisting of a 20 μm thick outermost polypropylene layer, a 150 μm and 200 μm thick soft aluminum foil or sheet layer as listed in Table 1, a 70 μm thick innermost polypropylene layer, and adhesive layers of maleic-anhydride polypropylene bonding the above layers.

Seal tabs 8 with the configuration as shown in FIG. 1 were formed from a laminate consisting a 32 μm thick polyethylene terephthalate layer, an urethane resin adhesive layer, a 50 μm thick soft aluminum foil layer, a maleic-anhydride-modified polypropylene adhesive layer and a 10 μm thick layer of a blend consisting of polypropylene (PP) and polyethylene (PE) (PP:PE=7:3 in weight). The seal tabs 8 were heat sealed to the blanks of lid proper using a hot plate to cover the opening 7 as shown in FIG. 1 under the conditions of 5 kg/cm$^2$ and 210° C. for 2 sec. The peeling strength of the tab was 1.4 to 1.8 kg/15 mm, and the tab was able to be peeled off readily by a hand.

Two kinds of lid blanks with the seal tabs 8 thus formed were shallow drawn to the lid members having the flange 15, the collar 17 of 70 mm outer diameter and the panel portion 16′ whose protruded height is 5 mm.

For sake of comparison, the lid members as those described above except that the blank for lid proper was formed from a laminate having an aluminum sheet of 300 μm thick (Type: 5052, H38) and the lid blank was shallow drawn to form a flat panel portion.

Three kinds of hermetic sealed containers 1 fabricated from the above-container bodies and lid members were applied with 6 kg/cm$^2$ internal pressure by means of the hydraulic tester and held for a given time at the pressure. The results are shown in Table 1.

TABLE 1 n = 10

| | Thickness of aluminum foil or sheet of lid proper (μm) | Protruded height of the panel portion (1) (mm) | | Spontaneous peeling of seal tab |
|---|---|---|---|---|
| | | After drawing | After application of internal pressure | |
| Present invention | 150 | 5.0 | 12.3 | No peeling and no leak after 30 days |
| | 200 | 5.0 | 8.1 | No peeling and no leak after 30 days |
| Comparison example | 300 | 0 | 2.2 | Leak due to peeling after 24 hours |

Note:
(1) Height of the outer surface of the apex measured from outer surface of the peripheral portion of the panel portion.

What is claimed is:

1. A hermatic sealed container filled with a positive pressure generating contents which is sealed with a lid comprising a spherical-shaped outwardly protruded panel portion formed with an opening, the panel portion being formed from a first flexible plastic laminate inclusive of a first metal foil layer, and a seal tab bonded to an outer surface of the panel portion to cover the opening, the seal tabl being formed from a second flexible plastic laminate inclusive of a second metal foil layer.

2. A hermatic sealed container according to claim 1 wherein a protruded height of the panel portion is at least 3 mm for a container having an internal diameter from 20 mm to 50 mm, at least 5 mm for a container having an internal diameter of 50 mm to 80 mm, and at least 7 mm for a container having an internal diameter of 80 mm to 120 mm.

3. A hermetic sealed container claimed in claim 1, wherein the outer layer of the first laminate forming the panel portion is formed of polypropylene, the inner layer of the second laminate forming the seal tab is formed of a blend of polypropylene and polyethylene, and the seal tab is heat sealed to the panel portion.

4. A hermetic sealed container claimed in claim 1, wherein the panel portion is outwardly protruded to be spherical-shaped by bulging with the positive pressure generated with the contents after sealed.

5. A hermetic sealed container claimed in claim 4, wherein the panel portion is outwardly protruded spherically to some extent prior to the sealing.

* * * * *